US009399537B1

(12) United States Patent
Gunderson

(10) Patent No.: US 9,399,537 B1
(45) Date of Patent: Jul. 26, 2016

(54) CONTAINER FOR SEMI-SOLID FOODS

(71) Applicant: Free Flow Fluids, LLC, Sun Prairie, WI (US)

(72) Inventor: Larry T Gunderson, Sun Prairie, WI (US)

(73) Assignee: Free Flow Fluids LLC, Sun Prairie, WI (US)

( * ) Notice: Subject to any disclaimer, the term of this patent is extended or adjusted under 35 U.S.C. 154(b) by 98 days.

(21) Appl. No.: 14/071,158

(22) Filed: Nov. 4, 2013

Related U.S. Application Data

(63) Continuation of application No. 12/846,945, filed on Jul. 30, 2010, now Pat. No. 8,574,647.

(60) Provisional application No. 61/230,137, filed on Jul. 31, 2009.

(51) Int. Cl.
*B65D 81/32* (2006.01)
*B65D 25/08* (2006.01)

(52) U.S. Cl.
CPC ..... *B65D 25/08* (2013.01)

(58) Field of Classification Search
CPC ..... B65D 25/04; B65D 81/3222; B65D 2217/04; B65D 25/08; A47G 19/02
USPC ..... 220/532, 23.87, 23.86; 426/115, 394, 426/120; 206/219; 222/126, 145.1
See application file for complete search history.

(56) References Cited

U.S. PATENT DOCUMENTS 4,277,000 A 7/1981 Jaarsma
5,209,348 A 5/1993 Schafer, III
5,588,561 A * 12/1996 Ness ..... A47G 19/02 206/217
5,706,980 A 1/1998 Dickerson
5,753,289 A 5/1998 Ness
6,264,068 B1 7/2001 Ours
6,273,299 B1 8/2001 Hernowitz
6,528,105 B1 3/2003 Gerhart
6,910,594 B2 6/2005 Foley
6,913,777 B2 7/2005 Rebhorn
7,063,229 B2 6/2006 Westerhof
7,147,880 B2 12/2006 Lenahan
7,820,214 B2 * 10/2010 Groenke ..... A47G 19/02 206/217
2009/0311389 A1 * 12/2009 Zoss ..... B65D 51/247 206/219

* cited by examiner

*Primary Examiner* — Chun Cheng

(74) *Attorney, Agent, or Firm* — Craig A. Fieschko, Esq.; DeWitt Ross & Stevens S.C.

(57) ABSTRACT

An exemplary device for semi-solid foods includes a separator for insertion in a food container having an optional lid. The separator provides an upper compartment for solid foods and a lower compartment for liquids. The separator has a base, and a ramp extending upwards therefrom. The separator preferably provides a barrier such that liquid in the container does not traverse the intersection between the separator and the container sidewall inner surface. When the container is tilted to dispense the food therein, liquid in the lower compartment flows out through a ramp opening (such as an aperture in the ramp or a separation between the ramp and the container sidewall), without flowing through a base aperture. When the container is returned to a level position, any fluid in the upper compartment may return to the lower compartment via an optional fluid channel in the ramp and through the base aperture.

20 Claims, 7 Drawing Sheets

CONTAINER FOR SEMI-SOLID FOODS

CROSS-REFERENCE TO RELATED APPLICATIONS

This application is a continuation of U.S. Utility patent application Ser. No. 12/846,945 filed Jul. 30, 2010, which claims priority under 35 USC §119(e) to U.S. Provisional Patent Application 61/230,137 filed Jul. 31, 2009, the entireties of which are incorporated by reference herein.

FIELD OF THE INVENTION

This document concerns an invention relating generally to containers for foodstuffs, and more specifically to containers allowing a user to more easily ingest semi-solid foodstuffs (such as cereals and soups) directly from the container.

BACKGROUND OF THE INVENTION

Many people consume food while engaged in other activities, such as while commuting to work, or while engaged in work activities. This is particularly common during breakfast. Cereal is a common breakfast food, and is conventionally consumed with a spoon from an open-topped bowl containing the cereal and milk, with the cereal often floating at or near the surface of the milk. However, it is difficult to eat cereal in this manner when one is engaged in other activities since it is unwieldy to carry and hold a bowl of cereal without risk of spilling. Attempting to consume cereal by "drinking" the cereal and milk from an open-topped cup is often unsuitable because the cup usually first presents the milk to the user, and then the cereal once the milk is substantially consumed. (Even then, the cereal tends to agglomerate in the bottom of the cup, and tends to come forward in bulk when the user tips the cup to his/her mouth, rather than in smaller and more manageable amounts.) Ordinarily, a user wishes to consume both cereal and milk at the same time. What is needed is a container allowing more convenient consumption of semi-solid foods directly from the container without the need for a spoon or other conventional utensils.

SUMMARY OF THE INVENTION

The invention, which is defined by the claims set forth at the end of this document, is directed to devices which at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring initially to FIG. 1A, a device 10 for semi-solid foods preferably includes a separator 100 that is sized to fit within a food container 200 (with an optional lid 12). As shown in FIG. 1C, the separator 100 preferably forms a barrier between upper and lower portions of the container 200, thereby defining an upper compartment 202 for solid foods and a lower compartment 204 for fluids on opposite sides of the separator 100. Liquids (such as milk) may be added to the container 200 (up to an optional fill line 206), and solids (such as cereal) may be added to the upper compartment 202. The separator 100 keeps the liquid and solid separate until the container 200 is tilted to dispense the solid and liquid. Liquid does not directly enter the upper compartment 202 from the lower compartment 204 as a result of the container 200 being tilted, helping minimize the mixing of the solid food and the liquid in the container 200 prior to consumption. Any liquid that reaches the upper compartment 202 (for example, by traversing the barrier between the separator 100 and the container 200) may flow back down into the lower compartment 204 through a base aperture 110.

The separator 100 (shown from the top rear in FIG. 1A and the bottom front in FIG. 1B) preferably includes a base 102 and an adjoining ramp 104. The base 102 may have a base top surface 106, an opposing base bottom surface 108, and at least one base aperture 110 extending between the base top surface 106 and the base bottom surface 108. Also, a base front end 112 and an opposing base rear end 114 may be included on opposite sides of the base top surface 106 and the base bottom surface 108, with the base front and rear ends 112/114 being bounded by a base perimeter 116. Additionally, the base 102 may have a base right side 118 and an opposing base left side 120 on opposite sides of the base front end 112 and the base rear end 114.

The separator 100's ramp 104 may have a ramp top end 122, and an opposing ramp bottom end 124 affixed to the base 102 a distance away from the base rear end 114. A ramp upper surface 126 and an opposing ramp lower surface 128 may extend between the ramp top end 122 and ramp bottom end 124, with a ramp opening 130 extending between the ramp upper surface 126 and the ramp lower surface 128. The ramp 104 may have a ramp right side 132 and an opposing ramp left side 134 on opposite sides of the ramp upper surface 126 and the ramp lower surface 128, with the ramp left and right sides 132/134 extending between the ramp top end 122 and the ramp bottom end 124. The ramp upper surface 126 may be angled at 90 degrees, but preferably more, with respect to the base top surface 106, depending on the dimensions of the container 200 to be used. An angle greater than 90 degrees helps slower-moving solids in the upper compartment 202 dispense from the container 200 closer in time with liquids in the lower compartment 204.

The container 200 in which the separator 100 is inserted may include a container sidewall 208 that bounds a container interior 210. The container sidewall 208 may extend vertically between a container top opening 212 and an opposing container floor 214, and extend laterally between a container sidewall front side 216 and an opposing container sidewall rear side 218. A container sidewall inner surface 220 and a container sidewall outer surface 222 are situated on opposing sides of the container sidewall 208.

The lower compartment 204 below the base 102 may be bounded by the ramp lower surface 128, the base bottom surface 108, and the container sidewall inner surface 220. Above the base 102 the upper compartment 202 may be bounded by the ramp upper surface 126, the base top surface 106, and the container sidewall inner surface 220. The base rear end 114 and ramp right and left sides 132/134 preferably complementarily abut the container's sidewall 208, with the base 102 and ramp 104 defining the barrier between upper and lower compartments 202/204 in the container's interior 210. The barrier preferably restricts liquid in the lower compartment 204 from flowing past the separator 100 except through the ramp opening 130 and the base aperture 110.

To help provide a stable fit and align the separator 100 in the container 200, the separator 100 may include a ramp support 136, situated above the base top surface 106 and extending between the ramp right side 132 and the ramp left side 134. The ramp support 136, which may have an outer ramp support perimeter 138 shaped complementarily with a projection of the base rear end 114 onto a plane situated above the base 102, and thus complementary with the container sidewall inner surface 220. To further help provide a good fit, a base support 140 may be provided below the ramp support 136. The base support 140 may extend between the base right side 118 and the base left side 120, having a shape that is complementary with a projection of the ramp support 136 (or a projection of the ramp right and left sides 132/134 and the ramp top end 122) onto a plane situated below the ramp support 136. The base support 140 is also preferably shaped to be complementary with the container sidewall inner surface 220. An optional elongated support member 142 may extend vertically between the ramp support 136 and the base rear end 114, abutting against the container sidewall inner surface 220 when the separator 100 is situated within the container interior 210.

Referring to FIGS. 2A, 2B, the separator 100 may include an optional separator sidewall 144 further defining the upper compartment 202. The separator sidewall 144 may continuously extend from the perimeter of the ramp right side 132 to the perimeter of the ramp left side 134, and from the perimeter of the base rear end 114 to the bottom of the ramp support 136. A separator sidewall front surface 146 may face the ramp upper surface 126, and a separator sidewall back surface 148 (opposing the separator sidewall front surface 146) may face the container sidewall inner surface 220. The separator sidewall back surface 148 may complementarily abut the container sidewall inner surface 220 to enhance the fit between the separator 100 and the container 200, and to help contain the liquid in the lower compartment 204. When the separator 100 includes the separator sidewall 144, the upper compartment 202 may be bounded by the ramp upper surface 126, the base top surface 106, and the separator sidewall front surface 146.

To help the liquid that has exited the container 200 through the ramp opening 130 return to the lower compartment 204, the ramp 104 may include one or more elongated fluid channels 150 depressed within the ramp upper surface 126 (see, for example, FIGS. 3A, 3B). The fluid channel 150 preferably extends the height of the ramp 104 from the ramp opening 130 at the ramp top end 122 to the base top surface 106 at the ramp bottom end 124.

Because the separator 100 may be removable from the container 200, a gripable flange 152 may extend outwardly from the ramp upper surface 126 and/or the separator sidewall front surface 146 to define a grip which can help the user engage and disengage the separator 100 and the container 200 (see FIGS. 1, 3A, 3B). The optional lid 12, which is preferably sized to cover the container top opening 212, may be pivotably affixed to the separator 100, such as through a hinge 14 or other mechanism (see FIGS. 4A, 4B).

Preferably, the device 10 is configured such that when the container 200 is tilted, with the container sidewall rear side 218 being elevated with respect to the container sidewall front side 216, fluid in the lower compartment 204 flows out of the lower compartment 204 through the ramp opening 130, but does not flow out of the lower compartment 204 through the base aperture 110. When the container 200 is returned to a level orientation following tilting, any liquid in the upper compartment 202 (originating from, for example, the ramp opening 130 or the user's mouth) can flow down the channel 150 (if present) and return to the lower compartment 204 through the base aperture 110. This helps limit premature mixing, helping keep the solid food dry so that it does not, for example, become soggy before it is dispensed.

If liquid is added to the lower compartment 204 above fill line 206 (or the liquid otherwise reaches above the base top surface 106), the liquid is overfilled and able to traverse the base aperture 110 to reach the upper compartment 202. In such a case, the initial "drinks" taken from the container 200 will include (the excess) liquid directly from the upper compartment 202. Because a higher proportion of liquid is initially dispensed when there is excess liquid in the container 200, the device 10 helps quickly self-correct the liquid overfill.

Because the ramp top end 122 preferably abuts the container sidewall inner surface 220 (see, for example, FIG. 3B), the liquid in the lower compartment 204 flows against the ramp lower surface 128 when the container 200 is tilted toward the container sidewall front side 216. That is, the liquid may collect in the region between the ramp lower surface 128 and the container sidewall inner surface 220 as it flows out of the lower compartment 204 through the ramp opening 130. This feature helps regulate the egress of liquid from the lower compartment 204 to a restricted rate so that the desired proportions of solid and liquid are mixed and the dispensing of the foods in the container 200 is more controllable.

Further advantages and features of the invention will be apparent from the remainder of this document in conjunction with the associated drawings.

DETAILED DESCRIPTION OF PREFERRED VERSIONS OF THE INVENTION

Figure 1A:
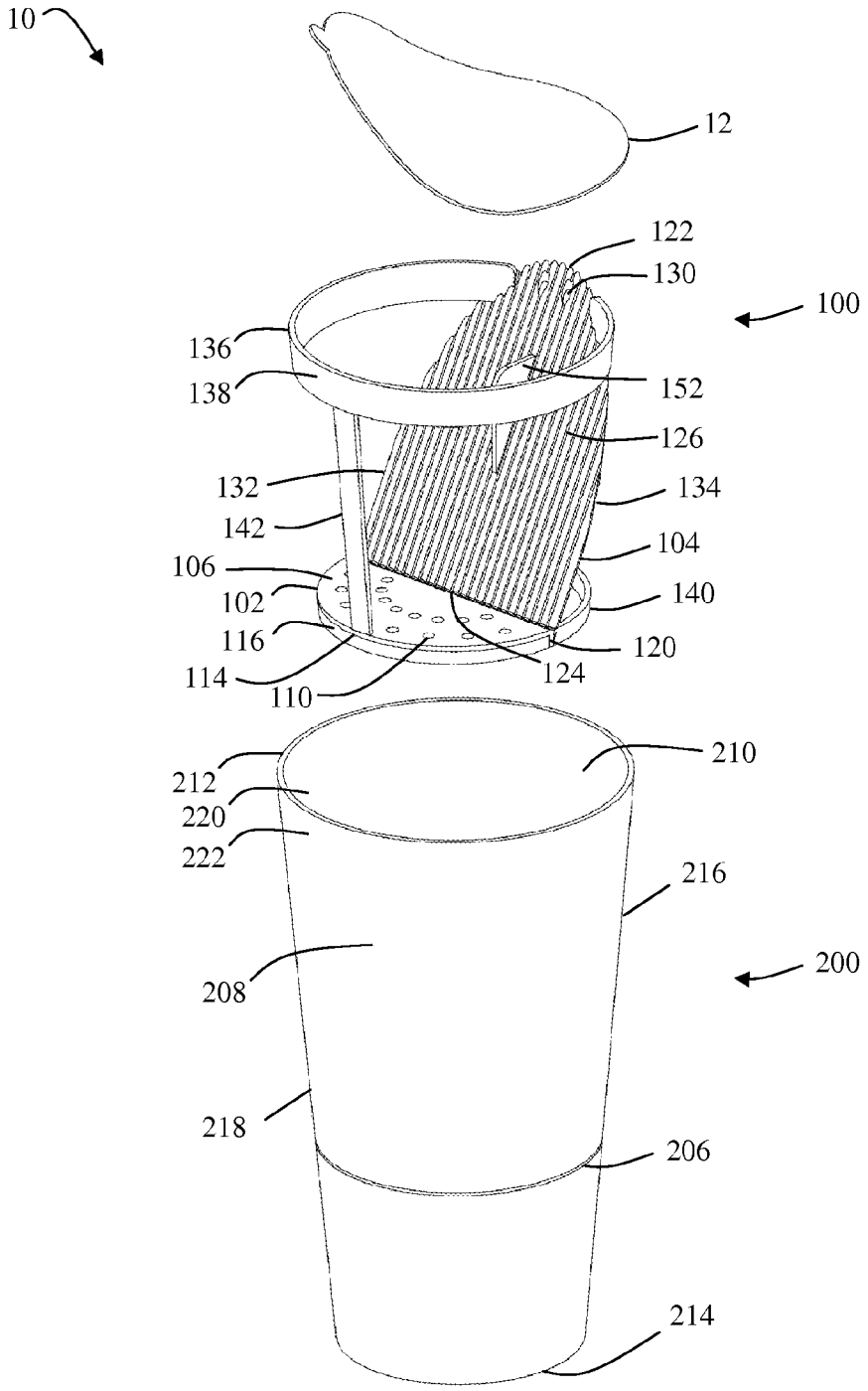
FIG. 1A shows an exploded (disassembled) view of an exemplary device 10 with a separator 100, a food container 200, and a lid 12.

Expanding on the discussion in the Summary above, to use the device 10, a user may obtain a container 200 with a separator 100 therein, or separately obtain a separator 100 and container 200 for assembly (by inserting the separator 100 into the container 200 through the container top opening 212). Once the separator 100 is in the container interior 210, the user may add the solid and liquid foods if not already in the container 200. The user may first add the liquid to the container 200, either with the separator 100 in the container 200 or before the separator 100 is in the container 200, up to the fill line 206. Preferably, the base 102 (and the optional base support 140) extends into the container interior 210 down to the fill line 206. If the liquid is added to the lower compartment 204 above the fill line 206, the liquid may traverse the base aperture 110 and mix with the solid in the upper compartment 202 prematurely. Alternatively, the solid may be added to the upper compartment 202 before the liquid is added to the lower compartment 204. However, if liquid is added to the lower compartment 204 when the separator 100 is in the container 200 and the upper compartment 202 contains solid food, the solid food may become wet (which may or may not be desirable).

To dispense the solid and liquid from the container 200, the user may tilt the container 200 toward the container sidewall front side 216. If the base front end 112 is aligned with the direction in which the container 200 is tilted, the liquid in the lower compartment 204 enters the space between the ramp lower surface 128 and the container sidewall inner surface 220. If the liquid in the container 200 did not rise above the fill line 206 (that is, if the container 200 was not filled above the base bottom surface 108), the liquid does not enter the upper compartment 202 through the base aperture 110. The solid may then exit the upper compartment 202 through the container top opening 212 as a result of gravity and/or other forces exerted by the user. The liquid may exit the container 200 through the container top opening 212 through the ramp opening 130 at a rate that is in dependent on such factors as the size of the ramp opening 130, the dimensions of the ramp 104, the angle between the base 102 and the ramp 104, the viscosity of the liquid, and the velocity at which the container 200 is tilted.

Figure 3A:
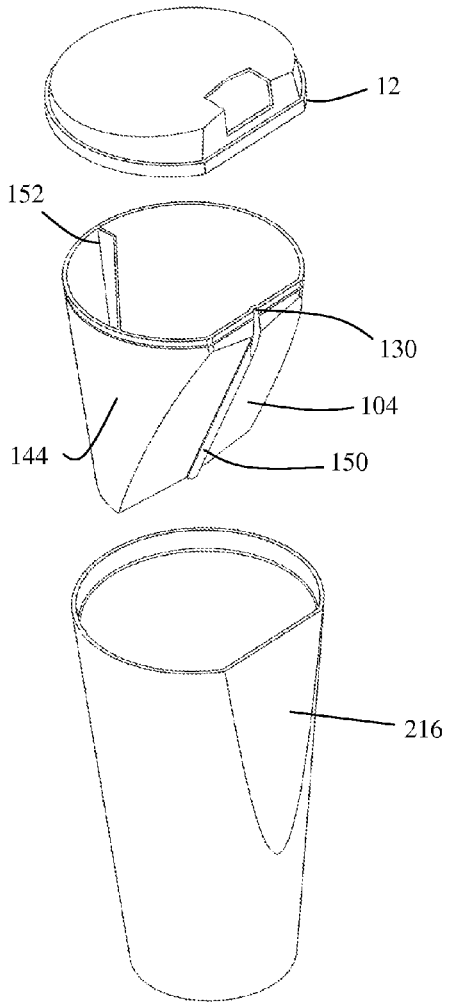
FIG. 3A shows an exploded (disassembled) view of a second alternative exemplary device 10 with a separator 100 having an alternative ramp opening 130, and a container 200 having an alternative container sidewall front side 216.

The ramp opening 130 allows liquid to exit the lower compartment 204 when, for example, the container 200 is tilted to dispense the food therein. As shown in FIG. 1A, the ramp opening 130 may be one or more apertures near the ramp top end 122, the apertures extending from the ramp upper surface 126 to the ramp lower surface 128. Alternatively, as shown in FIG. 3A, the ramp opening 130 may be an indentation, groove, or other structure defining a passage out of the lower compartment 204 between the ramp 104 and the container sidewall 208. Such a ramp opening 130 may provide an egress as a result of a separation of the ramp 104 from the container sidewall inner surface 220 rather than an aperture extending through the ramp 104. It is noted that the base aperture may similarly be replaced by one or more indentations, grooves, or other separations between the base rear end 114 and the container sidewall inner surface 220.

Although the above discussion has referred to one base aperture 110, the separator 100 may include two or more base apertures 110 spanning the base 102. Additional apertures may better allow any liquid that has entered the upper compartment 202 to drain back into lower compartment 204. The base aperture 110 is preferably sized such that solid food to be consumed cannot traverse it into the lower compartment 204. For example, the aperture may be sized to allow liquids to flow through them but to stop grains of rice, cereal, nuts, or other foods. The size of the aperture may be adjusted based on the food to be consumed.

Figure 5A:
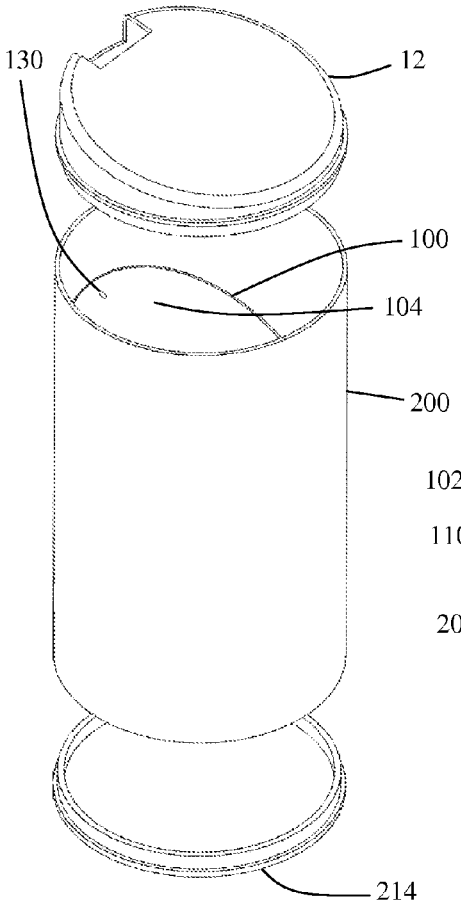
FIG. 5A shows a fifth alternative exemplary device 10 with a separator 100 affixed to the container 200, and a container 200 having a removable container floor 214.
Figure 5B:
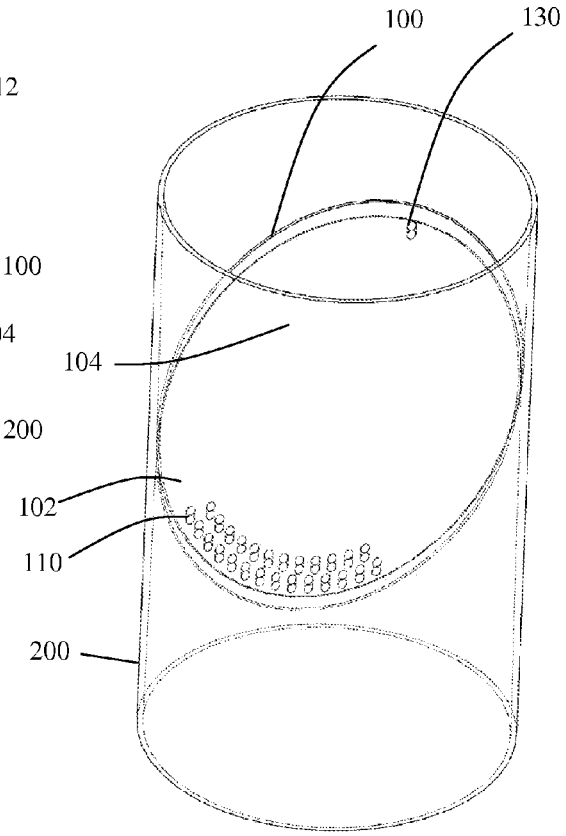
FIG. 5B shows the device 10 of FIG. 6A with a transparent container 200.

Returning to FIG. 1A, the container 200 and separator 100 may be provided together, with foods optionally vacuum-sealed in the container 200 by the lid 12. The lid 12 may then be removed and the desired liquid (if not already provided in the container 200) added to the container 200. The separator 100 may be removable or it may be joined to the container 200. As suggested by FIG. 5B, the container 200 may be provided as a unit with the separator 100 affixed thereto. In such a version, as depicted in FIG. 5A, the container floor 214 may be removable to, for example, make the lower compartment 204 more accessible. Providing a removable and reusable separator 100 may make cleaning and reinsertion of the separator 100 (into one or more containers 200) more convenient.

Figure 4A:
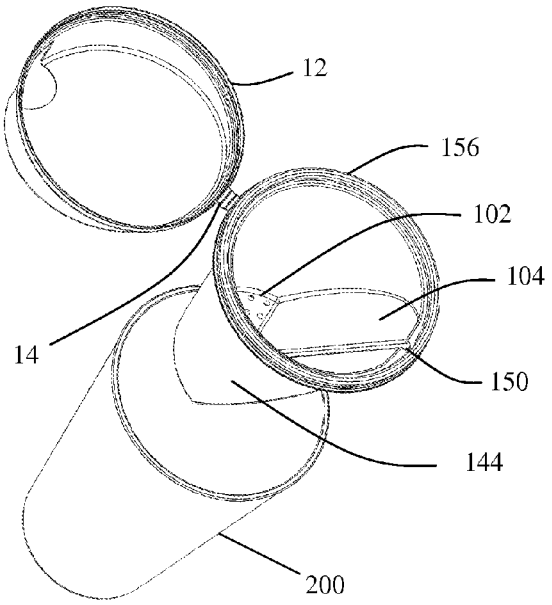
FIG. 4A shows an exploded (disassembled) view of a third alternative exemplary device 10 with a separator 100 having a pivotably-attached lid 12.
Figure 4B:
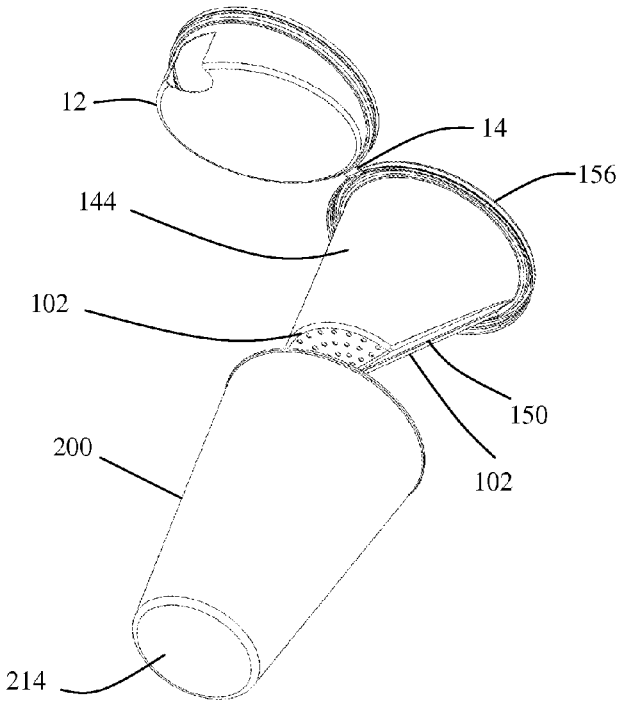
FIG. 4B shows the device 10 of FIG. 4A from an alternative perspective.

Referring to FIG. 4A, the separator 100 may be provided with the attached pivotable lid 12 (with or without solid food inside) for use with a variety of interchangeable containers 200. As shown in FIG. 4B, the separator 100 may have a rim 156 that fits over the top edge of the container sidewall 208. The lid 12 is dimensioned to complementarily fit over the separator, preferably sealing the contents thereof. The separator 100 is dimensioned to complementarily fit into and against the container 200, preferably sealing the contents thereof. Such complementary interaction provides a dual- or multi-type seal among the lid 12, separator 100, and container 200. Various separators 100, containers 200, and/or lids 12, and parts/features thereof, may be combined in many other ways to achieve the result desired.

It is noted that the seal between the separator 100 and the container 200 does not necessarily depend on the complementary fit of the base 102 and/or the ramp 104 against the container sidewall inner surface 220. Rather, especially when a separator sidewall 144 is included with the separator 100, the seal and/or barrier between the separator 100 and the container 200 could be based primarily on the interaction of (and/or the complementary fit between) the separator 100 and the container top opening 212 (rather than the container sidewall 208). For example, in FIGS. 2A, 2B, 4A, 4B, the rim 156 may be dimensioned such that it fits over the container top opening 212 and preferably provides a barrier and/or seal between the separator 100 and the container 200. It is also noted that any seepage from the barrier between the separator 100 and the container 200 preferably flows back to the lower compartment 204 through, for example, the base aperture 110.

As shown in FIG. 1A, the ramp 104 surface may be irregular, having, for example, ripples, or peaks separated by valleys. Such irregularity may help keep the solid foods from adhering to the ramp upper surface 126, especially solid foods that have become wet when being consumed. That is, irregularity decreases the surface area over which foods may make contact with (and stick to if wet) the ramp upper surface 126. Valleys in the ramp upper surface 126 may also provide channels in which fluid may flow toward the base 102 and back into the lower compartment 204 (through the base aperture 110) without making as much contact with the solid food in the upper container 200, helping keep the solid food drier.

In FIG. 1A, the base 102 and the ramp 104 may make an approximately 120-degree angle with each other, with the base top and bottom surfaces 106/108 parallel with each other and preferably with the container floor 214. However, the angle between the base 102 and the ramp 104 may be altered based on the dimensions of the container 200 and the angle between the base 102 and the container floor 214. If, for example, the container 200 greatly increases in width from the container floor 214 to the container top opening 212, the angle between the ramp 104 and the base 102 may be increased so that the ramp 104 may still engage the container sidewall inner surface 220 at the ramp top end 122. The angle may also be increased if the base rear end 114 is angled down closer toward the container floor 214. Conversely, the angle between the ramp 104 and the base 102 may be decreased to below 90 degrees if, for example, the base rear end 114 is angled upward closer to the container top opening 212. The angle between the base 102 and the ramp 104 may also be, for example, decreased to zero (see, for example, FIG. 5B) by angling the base rear end 114 downward closer to the container floor 214.

It should be understood that various terms referring to orientation and position are used throughout this document—for example, "vertical," "lateral," "front," "rear," "left," "right," etc.—are relative terms rather than absolute ones. In other words, it should be understood (for example) that where the food container 200 is described as having "vertical" container sidewalls 208, the sidewalls need not be exactly vertical (that is, perpendicular to the horizontal), and they need only extend to some degree in a vertical direction. Further, such terms are used from a common frame of reference. Thus, as examples, a "front" side should be regarded as such regardless of whether it is facing rearwardly to an observer; a "vertically extending" container sidewall 208 which extends "laterally" between opposing container sidewall front and rear sides 216, 218 should be regarded as meeting this description regardless of whether it is tipped so that the sidewall extends in a lateral direction to an observer, between vertically opposing first and second sides; and so forth. Consequently, such terms should be regarded as words of convenience, rather than limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Figure 1B:
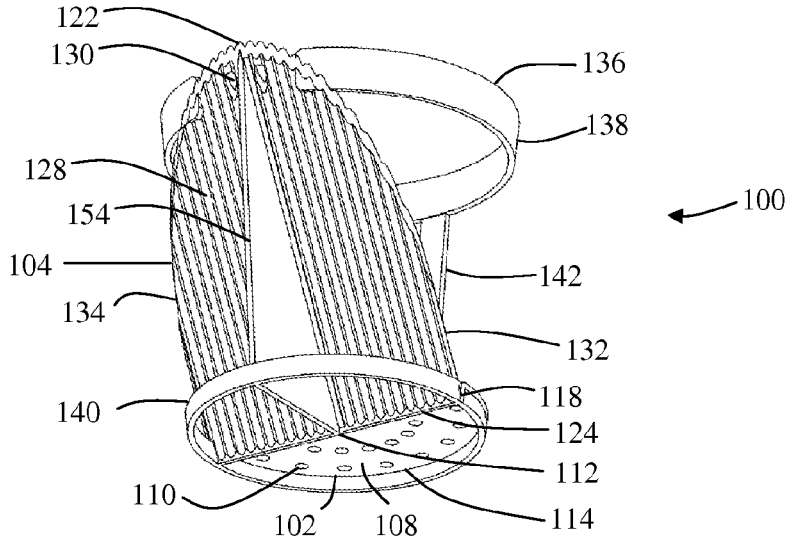
FIG. 1B shows the separator 100 of FIG. 1A from an alternative perspective.
Figure 1C:
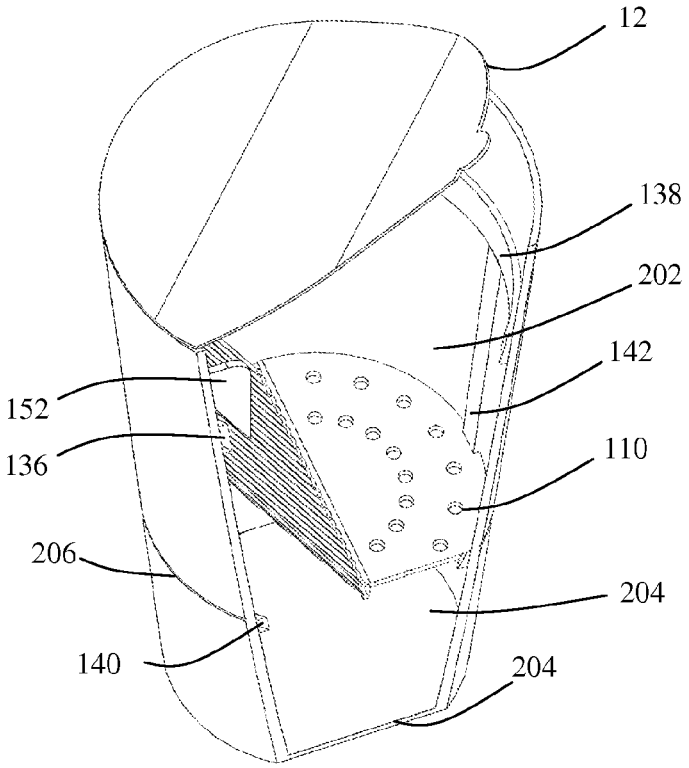
FIG. 1C shows a cross-section of the separator 100 of FIGS. 1, 2A inserted in the container 200 of FIG. 1A.

First, as shown in FIG. 1B, the ramp 104 extends upward from the edge of the base front end 112. The ramp 104, however, need not extend upward from where the base 102 terminates. Instead, the base front end 112 may extend further beyond the intersection of the base 102 and the ramp 104. That is, the base 102 need not terminate at the intersection of the base 102 and the ramp 104.

Second, as shown in FIG. 1B, the separator 100 may additionally be provided with a support flange 154 extending from the ramp lower surface 128 to the base support 140. The support flange 154 may provide the separator 100 with, for example, strength, stability, and enhanced gripability.

Third, the perimeters of such structures as the ramp support 136, the base support 140, the support member 142, and the base 102 are shown to be smooth and continuous. They may, however, be provided with irregular shapes (such as zig-zag) while retaining the overall functionality of the device 10. Similarly, the various surfaces of the device 10 may be irregular to, for example, reduce slippage or to distinguish between sides and/or parts.

Figure 2A:
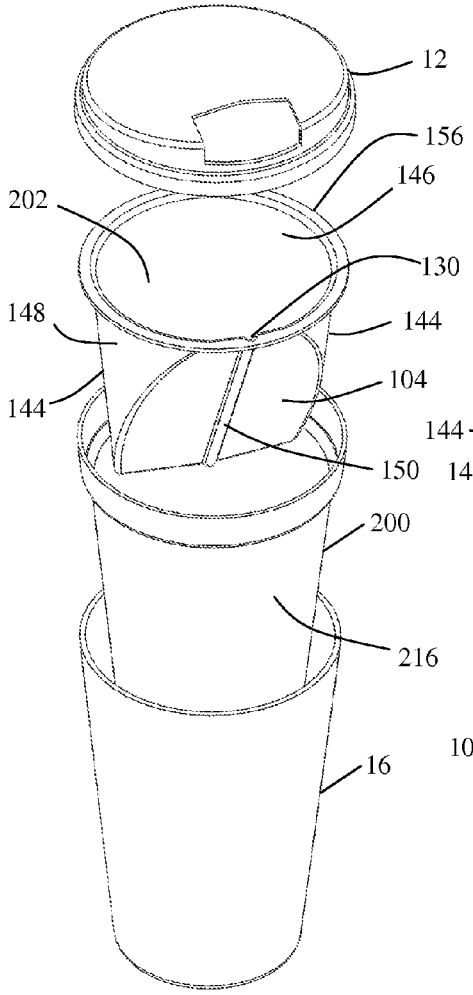
FIG. 2A shows an exploded (disassembled) view of a first alternative exemplary device 10 with a separator 100 having a separator sidewall 144 and with inner and outer containers 200.
Figure 2B:
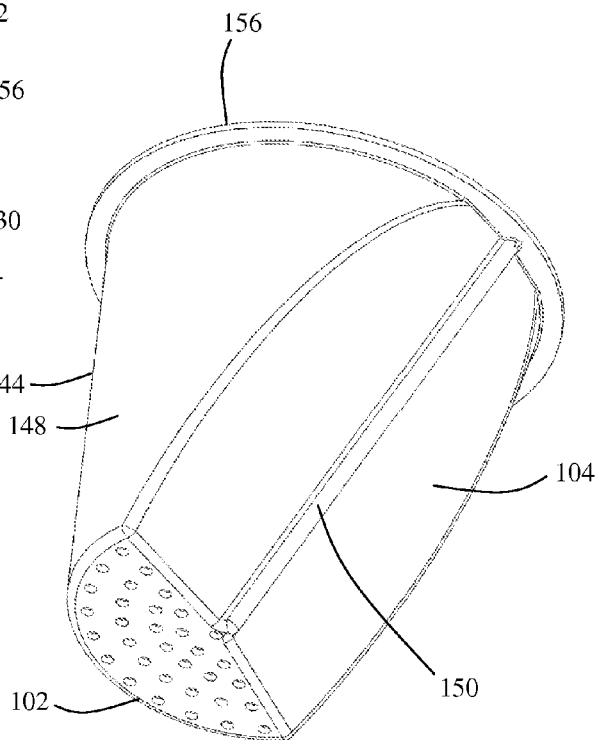
FIG. 2B shows the separator 100 of FIG. 2A from an alternative perspective.
Figure 3B:
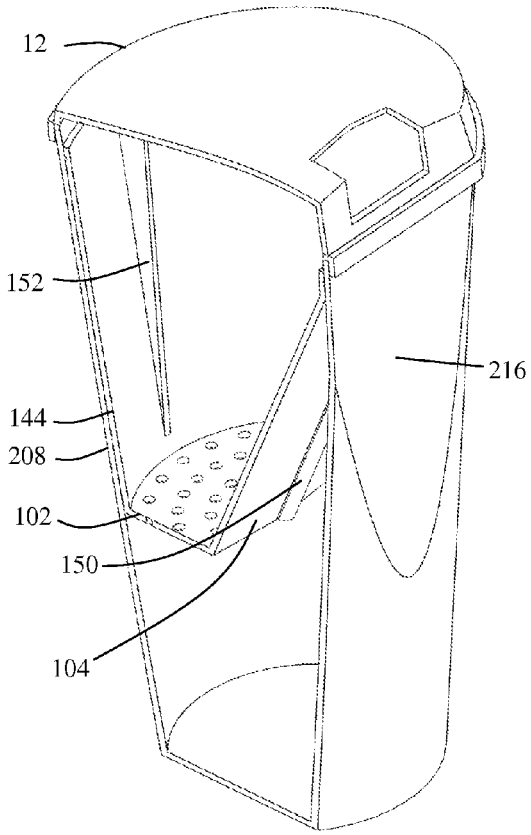
FIG. 3B shows a cross-section of the separator 100 of FIG. 3A inserted in the container 200 of FIG. 3A.

Fourth, as shown in FIGS. 3A, 3B, the container 200 may be given a shape on its container sidewall front side 216 that is different from the shape on its container sidewall rear side 218. Such a shape may be mated with the shape of the separator 100 so that the separator 100 better fits in the container interior 210 when the separator 100 is oriented a particular way. The different shapes may also help direct the user to properly orient the separator 100 when inserting it into the container 200 and properly tilt the container 200 (such as toward the base front end 112) to dispense the food therein. The lid 12 may also be given corresponding shapes on its opposing sides so that it provides the user with a cue as to which way the lid 12 should be placed on the container 200 and which way the container 200 should be tilted. For example, the lid 12 may be taller at a lid front side than at a lid rear side (see FIGS. 2A, 3A, 4A, 5A). It is noted that the shape of the lid opening may provide additional control over the rate of fluid flow out of the container 200 by limiting the liquid's/solid's/mixture's passageway.

Fifth, although the base 102 and ramp 104 are depicted in the figures as being substantially flat, they may have alternative shapes, including portions that are, for example, not parallel with each other. For example, the base 102 and/or ramp 104 in FIG. 1A may have a "V" (or inverted "V") or "U" (or inverted "U") shape, with their perimeters preferably maintaining complementarity with the container sidewall inner surface 220.

Sixth, as shown in FIG. 2A, the container 200 may be inserted into one or more secondary containers 16 for insulation. Depending on the size of the container 200 and/or secondary container(s) 16, multiple separators 100 may be inserted into the containers 200 and 16, or portions thereof, as desired.

Seventh, a separator 100 may be provided with a base 102 which includes a mechanism for adjusting the size of the base aperture 110. For example, the mechanism may be provided with a lever that, when swiveled, changes the diameter of the base aperture 110 as desired based on the size of the solid food to be added to the upper compartment 202.

Figure 6:
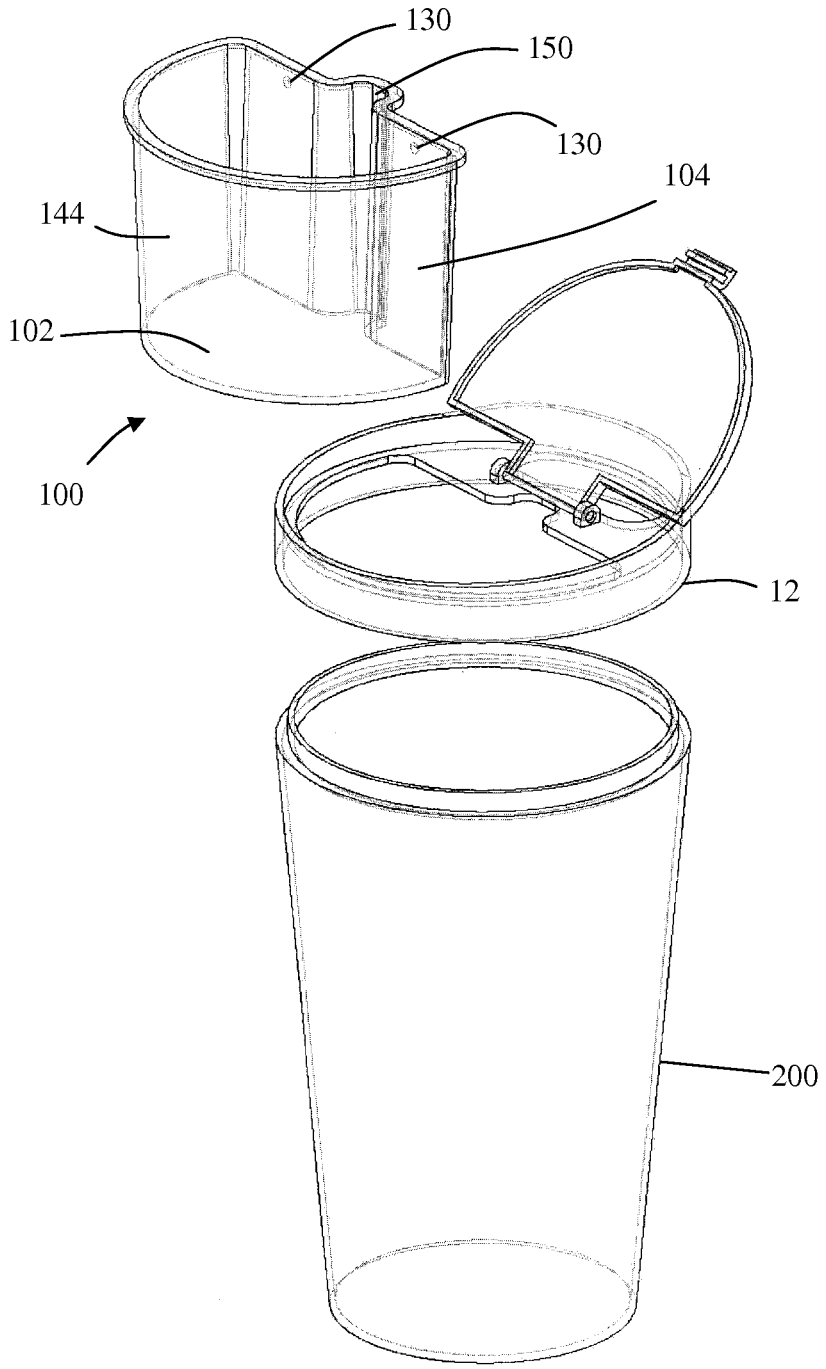
FIG. 6 shows an exploded view of a fourth alternative exemplary device 10 with a ramp 104 making a substantially 90-degree angle with the base 102.

Eighth, FIG. 6 depicts a version in which the base 102 and the ramp 104 are approximately perpendicular with each other. By manipulating the position of the ramp opening 130, for example, alternative versions may change the way in which the liquid flows through compartments and the solid and liquid foods mix.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A device for semi-solid foods:

a) including a separator configured to fit within a food container, the separator having:

1) a base:

(i) having a base top surface and an opposing base bottom surface, with a base aperture extending therebetween; and (ii) extending from a base front end to an opposing base rear end, the base front and rear ends being bounded by a base perimeter; and (iii) having a base support protruding from the base front end;

2) a ramp:

(i) having a ramp top end, and an opposing ramp bottom end joined to the base, the ramp being angled at 90 degrees or more with respect to the base, the ramp bottom end being spaced from the base rear end;

(ii) having a ramp opening situated at the ramp top end;

(iii) extending from a ramp left side to an opposing ramp right side; and (iv) having a ramp support situated above the base, the ramp support extending between the ramp left side and the ramp right side;

b) whereby the separator, when fit within the interior of a food container, has the base rear end, base support, and ramp support complementarily abut the container's sidewalls, with the base and ramp defining a barrier between upper and lower portions of the food container's interior.

2. The device of claim 1, wherein the ramp further includes an elongated fluid channel depressed within a ramp upper surface of the ramp, the fluid channel extending between the ramp top end and the ramp bottom end.

3. The device of claim 1:

a) further including a base right side and an opposing base left side on opposite sides of the base front end and the base rear end; and b) wherein the base support:

1) extends between the base right side and the base left side, and 2) has a shape that is at least substantially complementary with a projection of the ramp support onto a plane situated below the ramp support.

4. The device of claim 1 further including a separator sidewall extending continuously:

a) from a perimeter of the ramp right side to a perimeter of the ramp left side, and b) from a perimeter of the base rear end to a bottom of the ramp support.

5. The device of claim 1 further including a food container having a container sidewall:

a) extending vertically between a container top opening and an opposing container floor;

b) extending laterally between a container sidewall front side and an opposing container sidewall rear side;

c) having a container sidewall inner surface, and an opposing container sidewall outer surface; and d) bounding a container interior.

6. The device of claim 5 further including an elongated support member:

a) extending at least substantially vertically between the ramp support and the base rear end, wherein the ramp support is at least partly separated from the ramp left side and the ramp right side, and b) abutting against the container sidewall inner surface when the separator is inserted within the container interior.

7. The device of claim 5, wherein when the separator is at least partially inserted in the container, the separator defines:

(a) a lower compartment in the lower portion of the container interior beneath the separator, with liquid within the lower compartment being at least substantially restricted from flow past the separator except through the ramp opening when the container is tilted ninety degrees towards the container sidewall front side to dispense food therefrom; and (b) an upper compartment in the upper portion of the container interior above the separator, the upper compartment being bounded by the ramp, the base, the container sidewall inner surface, and the container top opening.

8. The device of claim 5, wherein the perimeter of the ramp support, the perimeter of the base rear end, and the perimeter of the base support are shaped to complementary fit against the container sidewall inner surface.

9. The device of claim 8 wherein:

a) the base support:

1) is situated below the ramp support and extends between the base right side and the base left side; and 2) has a shape that is at least substantially complementary with a projection of the ramp support onto a plane situated below the ramp support;

b) the base support is shaped to complementary fit against the container sidewall inner surface.

10. The device of claim 5, wherein the device is configured such that when the container is tilted in the direction of the container sidewall front side, fluid in the lower compartment:

a) flows out of the lower compartment through the ramp opening, and b) does not flow out of the lower compartment through the base aperture.

11. The device of claim 5:

a) further including a separator sidewall extending continuously:

1) from the perimeter of the ramp right side to the perimeter of the ramp left side, and 2) from the perimeter of the base rear end to the bottom of the ramp support;

b) wherein the separator sidewall abuts the container sidewall inner surface.

12. The device of claim 11, wherein:

a) the separator sidewall further includes a separator sidewall front surface facing the ramp upper surface, and an opposing separator sidewall back surface facing the container sidewall inner surface, and b) the device further includes a gripable flange extending out from at least one of the ramp upper surface and the separator sidewall front surface.

13. The device of claim 5 further including a lid sized to cover the container top opening, the lid pivotably affixed to the separator.

14. The device of claim 1 wherein the ramp support:

a) protrudes outwardly from the ramp, and b) is shaped at least substantially complementarily with a projection of the base support onto a plane situated above the base.

15. The device of claim 1 further including a gripable flange extending out from a ramp upper surface.

16. A device for semi-solid foods:

a) including:

1) a food container having a container sidewall:

(i) extending vertically between a container top opening and an opposing container floor;

(ii) extending laterally between a container sidewall front side and an opposing container sidewall rear side;

(iii) having a container sidewall inner surface, and an opposing container sidewall outer surface; and (iv) bounding a container interior; and 2) a separator sized to at least partially fit within the food container interior, the separator having:

(i) a base:

(a) having a base top surface and an opposing base bottom surface, with a base aperture extending therebetween; and (b) extending from a base front end to an opposing base rear end, the base rear end being shaped to complementarily fit against the container sidewall inner surface at the container sidewall rear side when the separator is fit within the container interior; and (c) having a base support protruding from the base front end, the base support being shaped to complementary fit against the container sidewall inner surface at the container sidewall front side when the separator is fit within the container interior;

(ii) a ramp having:

(a) a ramp top end, and an opposing ramp bottom end joined to the base, the ramp bottom end being spaced from the base rear end;

(b) a ramp upper surface and an opposing ramp lower surface extending between the ramp top end and ramp bottom end, with:

i. a ramp opening extending between the ramp upper surface and the ramp lower surface, and ii. the ramp upper surface being angled at 90 degrees or more with respect to the base top surface, and (c) a ramp left side and an opposing ramp right side on opposite sides of the ramp upper surface and the ramp lower surface, and extending between the ramp top end and the ramp bottom end, the ramp left and right sides being shaped to complementarily fit against the container sidewall inner surface at the container sidewall front side when the separator is fit within the container interior;

b) whereby the separator, when fit within the container interior, defines a lower compartment in the container interior beneath the separator, with liquid within the lower compartment being at least substantially restricted from flow past the separator except through the ramp opening and the base aperture.

17. The device of claim 16:

a) further including:

1) a base right side and an opposing base left side on opposite sides of the base front end and the base rear end;

2) a ramp support situated above the base top surface, the ramp support extending between the ramp right side and the ramp left side; and 3) a base support situated below the ramp support and extending between the base right side and the base left side;

b) wherein:

1) the ramp support and the base support are shaped at least substantially complementarily with the container sidewall inner surface, and 2) the base rear end complementarily engages the container sidewall inner surface at the container sidewall rear side.

18. The device of claim 16:

a) further including:

1) an upper compartment above the separator;

2) a separator sidewall further enclosing the upper compartment, the separator sidewall extending continuously:

(i) from the perimeter of the ramp right side to the perimeter of the ramp left side, and (ii) from the perimeter of the base rear end to the bottom of the ramp support;

b) wherein:

1) the upper compartment is further bounded by the ramp upper surface and the base top surface, and 2) the separator sidewall is shaped to complementarily fit against the container sidewall inner surface.

19. The device of claim 18 further including a lid sized to cover the container top opening, the lid pivotably affixed to the separator via a hinge mechanism, wherein:

a) the lid is configured to seal the upper compartment, and b) the separator is configured to seal the lower compartment.

20. A device for semi-solid foods:

a) including a separator configured to fit within a food container, the separator having:

1) a base having:

(i) a base top surface and an opposing base bottom surface, with a base aperture extending therebetween; and (ii) a base front end and an opposing base rear end on opposite sides of the base top surface and the base bottom surface, the base front and rear ends being bounded by a base perimeter; and 2) a ramp having:

(i) a ramp top end, and an opposing ramp bottom end joined to the base, the ramp bottom end being spaced from the base rear end; and (ii) a ramp upper surface and an opposing ramp lower surface extending between the ramp top end and ramp bottom end, with:

(a) a ramp opening situated at the ramp top end;

(b) the ramp upper surface being angled at 90 degrees or more with respect to the base top surface;

(c) a ramp left side and an opposing ramp right side on opposite sides of the ramp upper surface and the ramp lower surface, and extending between the ramp top end and the ramp bottom end; and (d) a ramp support situated above the base top surface, the ramp support:

i. extending between the ramp left side and the ramp right side; and ii. having an outer ramp support perimeter shaped at least substantially complementarily with a projection of the base rear end onto a plane situated above the base;

b) including a food container having a container sidewall:

1) extending vertically between a container top opening and an opposing container floor;

2) extending laterally between a container sidewall front side and an opposing container sidewall rear side;

3) having a container sidewall inner surface, and an opposing container sidewall outer surface; and 4) bounding a container interior;

c) including a base support protruding from the base front end, 1) the base support:

(i) situated below the ramp support and extending between the base right side and the base left side; and (ii) having a shape that is at least substantially complementary with a projection of the ramp support onto a plane situated below the ramp support;

2) wherein the base support is shaped to complementary fit against the container sidewall inner surface; and d) wherein the perimeter of the ramp support, the perimeter of the base rear end, the perimeter of the ramp right side, and the perimeter of the ramp left side are shaped to complementary fit against the container sidewall inner surface;

e) whereby the separator, when fit within the interior of a food container, has the base rear end and outer ramp support perimeter complementarily abut the container's sidewalls, with the base and ramp defining a barrier between upper and lower portions of the food container's interior.

* * * * *